US010662778B2

(12) United States Patent
Marsh et al.

(10) Patent No.: US 10,662,778 B2
(45) Date of Patent: May 26, 2020

(54) TURBINE AIRFOIL WITH INTERNAL IMPINGEMENT COOLING FEATURE

(71) Applicant: Siemens Aktiengesellschaft, München (DE)

(72) Inventors: Jan H. Marsh, Orlando, FL (US); Paul A. Sanders, Cullowhee, NC (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 14 days.

(21) Appl. No.: 15/750,513

(22) PCT Filed: Aug. 28, 2015

(86) PCT No.: PCT/US2015/047328
§ 371 (c)(1),
(2) Date: Feb. 6, 2018

(87) PCT Pub. No.: WO2017/039569
PCT Pub. Date: Mar. 9, 2017

(65) Prior Publication Data

US 2018/0223671 A1 Aug. 9, 2018

(51) Int. Cl.
*F01D 5/18* (2006.01)

(52) U.S. Cl.
CPC ..... *F01D 5/18* (2013.01); *F05D 2220/32* (2013.01); *F05D 2250/75* (2013.01); *F05D 2260/201* (2013.01)

(58) Field of Classification Search
CPC . F01D 5/18; F01D 5/186; F01D 5/187; F01D 5/188; F01D 5/147; F05D 2260/20; F05D 2260/201
See application file for complete search history.

(56) References Cited

U.S. PATENT DOCUMENTS 3,891,348 A * 6/1975 Auxier ..... F01D 5/189 416/96 A
4,063,851 A 12/1977 Weldon
(Continued)

FOREIGN PATENT DOCUMENTS

EP 0392664 A2 10/1990
EP 2716868 A2 4/2014
(Continued)

OTHER PUBLICATIONS

PCT International Search Report and Written Opinion dated May 2, 2016 corresponding to PCT Application PCT/US2015/0047328 filed Aug. 28, 2015.

*Primary Examiner* — Kenneth Bomberg
*Assistant Examiner* — Maxime M Adjagbe

(57) ABSTRACT

A turbine airfoil (10) includes an impingement structure (26A, 26B) comprising a hollow elongated main body (28) positioned in an interior portion (11) of an airfoil body (12). The main body (28) extends lengthwise along a radial direction and defines coolant cavity (64) therewithin that receives a cooling fluid (60). The main body (28) is spaced from a pressure side wall (16) and a suction side wall (18) of the airfoil body (12) and may be spaced from an airfoil tip (52), to define respective passages (72, 74, 77) therebetween. A plurality of impingement openings (25) are formed through the main body (28) that connect the coolant cavity (64) with one or more of the respective passages (72, 74, 77). The impingement openings (25) direct the cooling fluid (60) flowing in the coolant cavity (64) to impinge on the pressure and/or suction side walls (16, 18) and/or the airfoil tip (52).

13 Claims, 3 Drawing Sheets

(56) References Cited

U.S. PATENT DOCUMENTS

| | | | | |
|---|---|---|---|---|
| 5,762,471 | A | 6/1998 | Cunha | |
| 7,871,246 | B2 * | 1/2011 | Liang | F01D 5/187 416/97 R |
| 7,905,706 | B1 * | 3/2011 | Liang | F01D 5/14 415/115 |
| 2012/0269647 | A1 * | 10/2012 | Vitt | F01D 5/186 416/97 R |

FOREIGN PATENT DOCUMENTS

| | | | |
|---|---|---|---|
| JP | H03264702 | A | 11/1991 |
| JP | 2014181715 | A | 9/2014 |
| JP | 2017031973 | A | 2/2017 |
| WO | 2008081486 | A1 | 7/2008 |

* cited by examiner

VIEW II-II

VIEW III-III

VIEW IV-IV

TURBINE AIRFOIL WITH INTERNAL IMPINGEMENT COOLING FEATURE

BACKGROUND

1. Field

The present invention is directed generally to turbine airfoils, and more particularly to an internally cooled turbine airfoil.

2. Description of the Related Art

In a turbomachine, such as a gas turbine engine, air is pressurized in a compressor section and then mixed with fuel and burned in a combustor section to generate hot combustion gases. The hot combustion gases are expanded within a turbine section of the engine where energy is extracted to power the compressor section and to produce useful work, such as turning a generator to produce electricity. The hot combustion gases travel through a series of turbine stages within the turbine section. A turbine stage may include a row of stationary airfoils, i.e., vanes, followed by a row of rotating airfoils, i.e., turbine blades, where the turbine blades extract energy from the hot combustion gases for providing output power. Since the airfoils, i.e., vanes and turbine blades, are directly exposed to the hot combustion gases, they are typically provided with internal cooling channels that conduct a cooling fluid, such as compressor bleed air, through the airfoil.

One type of airfoil extends from a radially inner platform at a root end to a radially outer portion of the airfoil, and includes opposite pressure and suction side walls extending span-wise along a radial direction and extending axially from a leading edge to a trailing edge of the airfoil. The cooling channels extend inside the airfoil between the pressure and suction side walls and may conduct the cooling fluid in a radial direction through the airfoil. The cooling channels remove heat from the pressure side wall and the suction side wall and thereby avoid overheating of these parts.

SUMMARY

Briefly, aspects of the present invention provide a turbine airfoil having an internal impingement cooling feature.

Embodiments of the present invention provide a turbine airfoil that comprises a generally hollow airfoil body formed by an outer wall extending span-wise along a radial direction. The outer wall comprises a pressure side wall and a suction side wall joined at a leading edge and a trailing edge. A chordal axis is defined extending generally centrally between the pressure side wall and the suction side wall.

According to a first aspect of the invention, a turbine airfoil comprises an impingement structure comprising a hollow elongated main body positioned in an interior portion of the airfoil body and extending lengthwise along the radial direction. The main body defines a coolant cavity therewithin that receives a cooling fluid. The main body is spaced from the pressure side wall and the suction side wall, such that a first near wall passage is defined between the main body and the pressure side wall and a second near wall passage is defined between the main body and the suction side wall. A plurality of impingement openings are formed through the main body that connect the coolant cavity with the first and second near wall passages. The impingement openings direct the cooling fluid flowing in the coolant cavity to impinge on the pressure and/or suction side walls.

According to a second aspect of the invention, a turbine airfoil is provided with an impingement structure comprising a hollow elongated main body positioned in an interior portion of the airfoil body and extending lengthwise along the radial direction. The main body defines a coolant cavity therewithin that receives a cooling fluid. The main body is spaced from the pressure side wall, the suction side wall and the airfoil tip, such that a first near wall passage is defined between the main body and the pressure side wall, a second near wall passage is defined between the main body and the suction side wall and a tip cooling passage is defined between main body and the airfoil tip. A plurality of impingement openings are formed through the main body that connect the coolant cavity with the first and second near wall passages and the tip cooling passage, for directing the cooling fluid flowing in the coolant cavity to impinge on the pressure side wall and/or suction side wall and/or the airfoil tip.

BRIEF DESCRIPTION OF THE DRAWINGS

The invention is shown in more detail by help of figures. The figures show preferred configurations and do not limit the scope of the invention.

DETAILED DESCRIPTION

Figure 1:
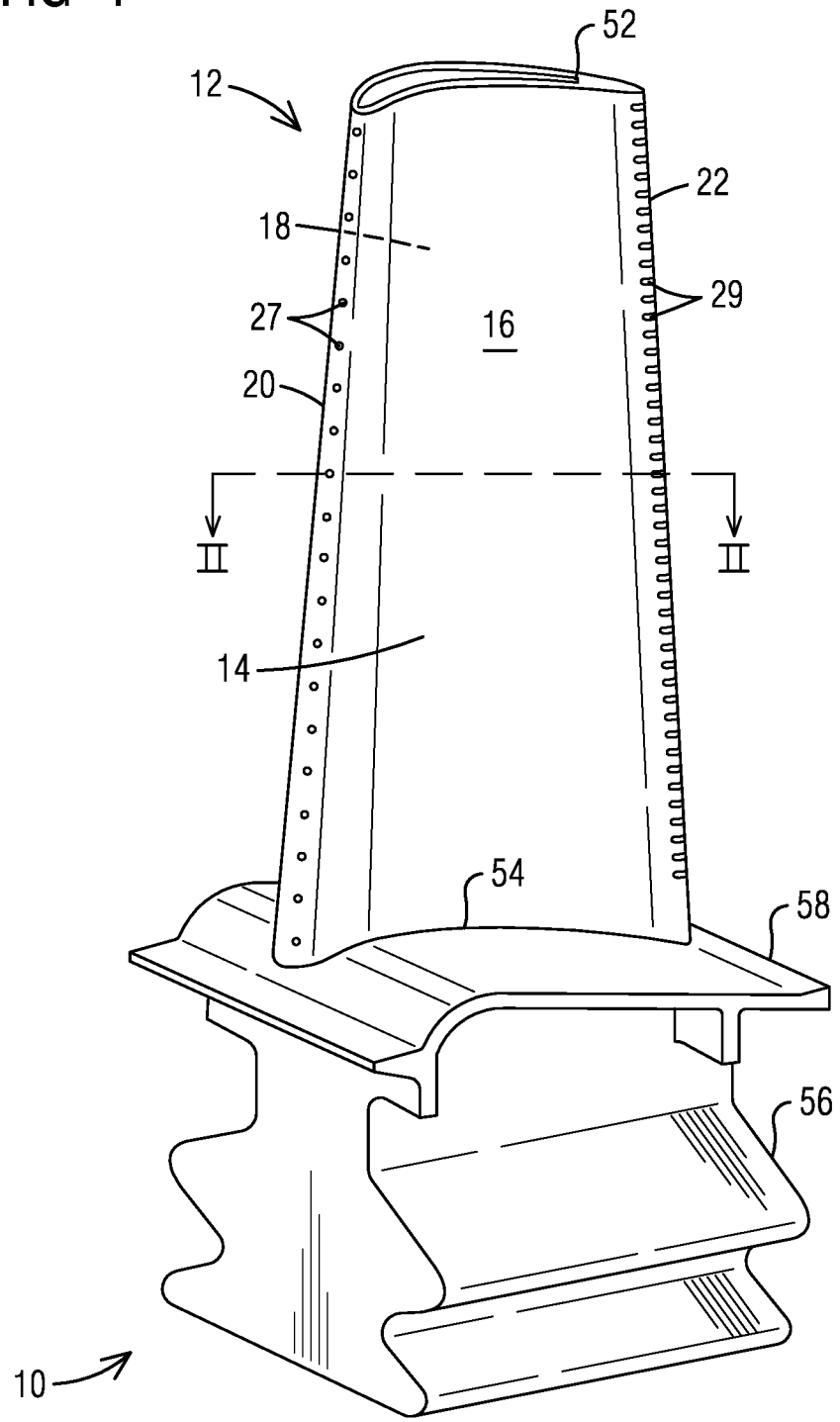
FIG. 1 is a perspective view of an example of a turbine airfoil according to one embodiment.

In the following detailed description of the preferred embodiment, reference is made to the accompanying drawings that form a part hereof, and in which is shown by way of illustration, and not by way of limitation, a specific embodiment in which the invention may be practiced. In the drawings, like numerals represent like or generally similar elements.

Aspects of the present invention relate to an internally cooled turbine airfoil. In a gas turbine engine, coolant supplied to the internal cooling passages in a turbine airfoil often comprises air diverted from a compressor section. In many turbine airfoils, the cooling passages extend inside the airfoil between the pressure and suction side walls and may conduct the coolant air in alternating radial directions through the airfoil, to form a serpentine cooling path. Achieving a high cooling efficiency based on the rate of heat transfer is a significant design consideration in order to minimize the volume of coolant air diverted from the compressor for cooling. As available coolant air is reduced, it may become significantly harder to cool the airfoil. For example, in addition to being able to carry less heat out of the airfoil, lower coolant flows may also make it difficult to generate high enough internal Mach numbers to meet the cooling requirements. One way of addressing this problem is to reduce the flow cross-section of the radial cooling passages, displacing the coolant flow from the centre of the airfoil toward the hot pressure and suction side walls. The present inventors have noted that in a serpentine cooling scheme, the coolant may heat up as it remains within the airfoil for a relatively long time. For this reason, especially for low coolant flows, there may be heavy reliance on the thermal barrier coating (TBC) on the external wall of the airfoil. In the event of a spallation of the TBC, the heat of up the coolant may further increase, which may negatively affect the downstream passages of the serpentine.

Embodiments of the present invention illustrated in FIGS. 1-4 provide a turbine airfoil with an internal impingement cooling feature, which may, for example, replace at least a portion of, if not all of, the above-mentioned serpentine cooling scheme. Using an impingement cooling feature not only provides higher local heat transfer coefficients, but due to its very nature reduces the distances the coolant must travel within the airfoil, whereby one or more of the above noted conditions may be alleviated. In particular, the illustrated embodiments provide an inventive impingement structure that provides targeted impingement cooling to regions that need the most cooling, i.e., the pressure and suction side walls, thereby providing highly efficient use of the coolant air. The illustrated embodiments also make it possible to increase heat transfer coefficients relative to a serpentine design, to potentially allow thinner TBCs on the external walls.

Referring now to FIG. 1, a turbine airfoil 10 is illustrated according to one embodiment. As illustrated, the airfoil 10 is a turbine blade for a gas turbine engine. It should however be noted that aspects of the invention could additionally be incorporated into stationary vanes in a gas turbine engine. The turbine airfoil 10 may include a generally elongated hollow airfoil body 12 formed from an outer wall 14 adapted for use, for example, in a high pressure stage of an axial flow gas turbine engine. The outer wall 14 extends span-wise along a radial direction of the turbine engine and includes a generally concave shaped pressure side wall 16 and a generally convex shaped suction side wall 18. The pressure side wall 16 and the suction side wall 18 are joined at a leading edge 20 and at a trailing edge 22. As illustrated, the generally elongated hollow airfoil body 12 may be coupled to a root 56 at a platform 58. The root 56 may couple the turbine airfoil 10 to a disc (not shown) of the turbine engine. The generally hollow airfoil body 12 is delimited in the radial direction by a radially outer end face or airfoil tip 52 and a radially inner end face 54 coupled to the platform 58. In other embodiments, the turbine airfoil 10 may be a stationary turbine vane with a radially inner end face coupled to the inner diameter of the turbine section of the turbine engine and a radially outer end face coupled to the outer diameter of the turbine section of the turbine engine. A thermal barrier coating (TBC) may be provided on the external surfaces of the turbine airfoil 10 exposed to hot gases, as known to one skilled in the art.

Figure 2:
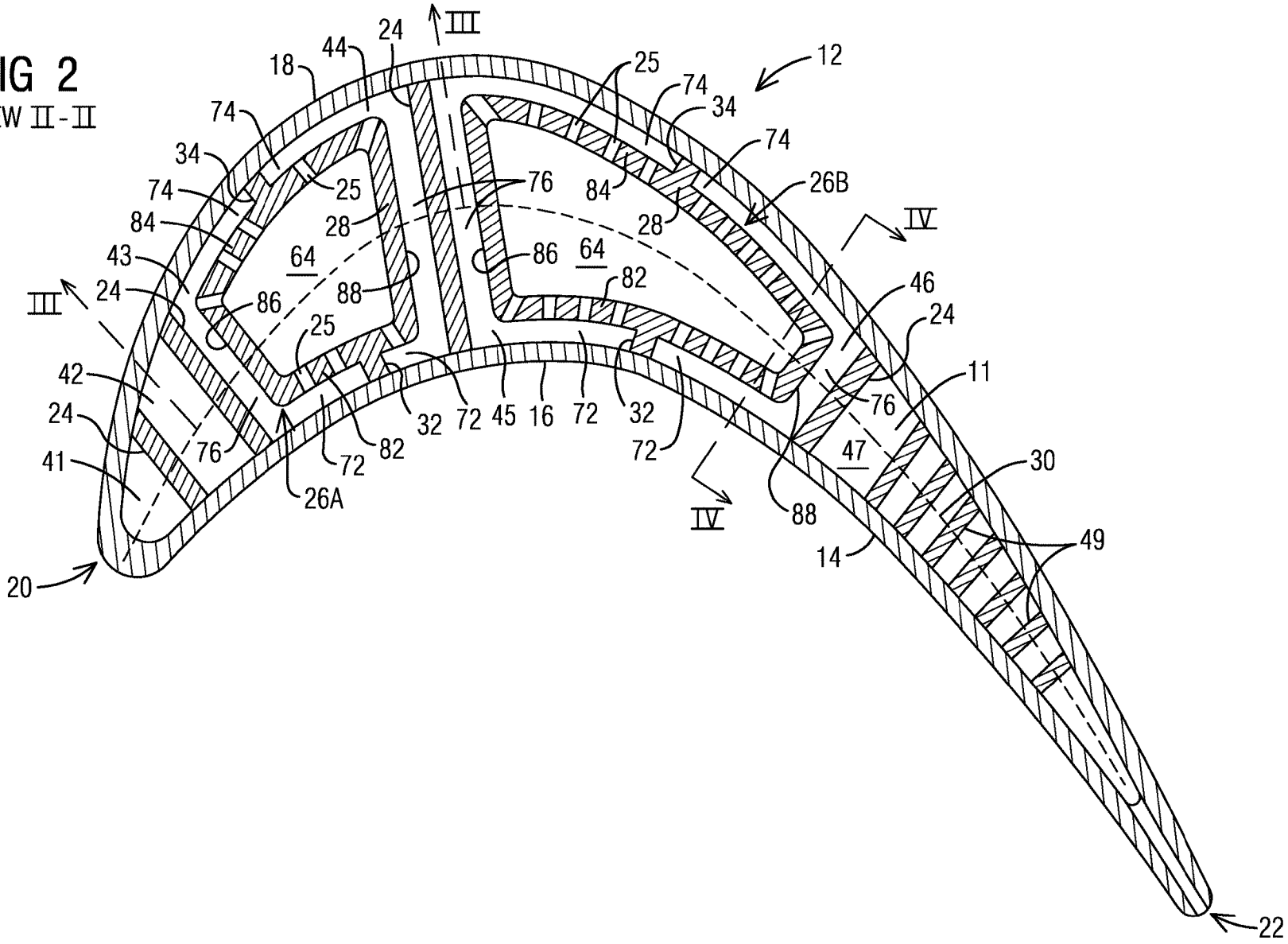
FIG. 2 is a cross-sectional view through the turbine airfoil along the section II-II of FIG. 1, illustrating aspects of the present invention.

Referring to FIG. 2, a chordal axis 30 is defined extending generally centrally between the pressure side wall 16 and the suction side wall 18. As illustrated, the generally hollow elongated airfoil body 12 comprises an interior portion 11, within which a plurality of partition walls 24 are positioned spaced apart chordally, i.e., along the chordal axis 30. The partition walls 24 extend radially, and further extend linearly across the chordal axis 30 connecting the pressure side wall 16 and the suction side wall 18 to define radial cavities 41-47 that form internal cooling passages. A cooling fluid, such as air from a compressor section (not shown), flows through the internal cooling passages 41-47 and exits the airfoil body 12 via exhaust orifices 27 and 29 positioned along the leading edge 20 and the trailing edge 22 respectively. The exhaust orifices 27 provide film cooling along the leading edge 20 (see FIG. 1). Although not shown in the drawings, film cooling orifices may be provided at multiple locations, including anywhere on the pressure side wall 16, suction side wall 18, leading edge 20 and the airfoil tip 52. However, embodiments of the present invention provide enhanced heat transfer coefficients using low coolant flow, which make it possible to limit film cooling only to the leading edge 20, as shown in FIG. 1.

Figure 3:
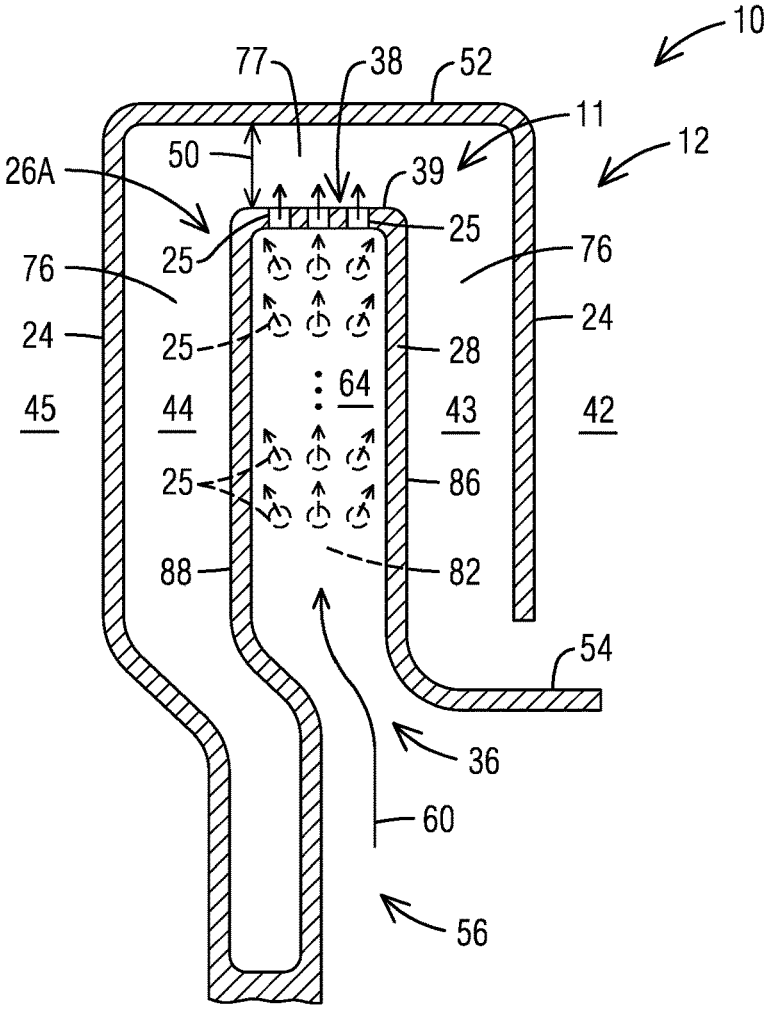
FIG. 3 is a schematic cross-sectional side view along the section III-III of FIG. 2.
Figure 4:
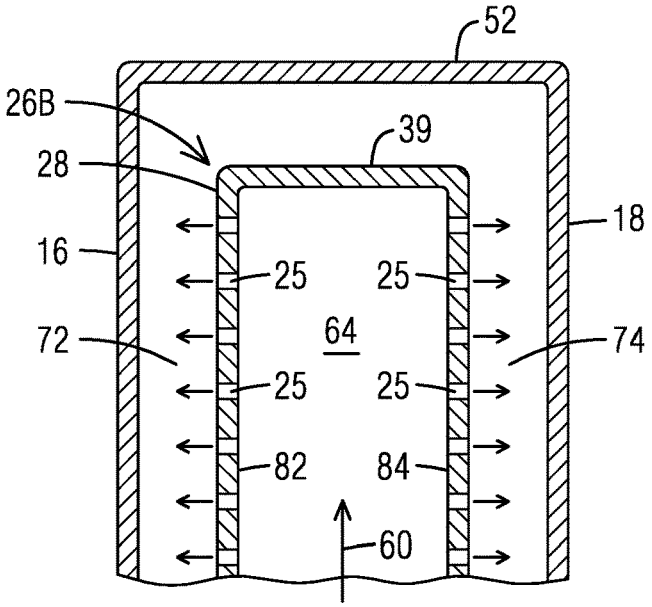
FIG. 4 is a schematic cross-sectional view along the section IV-IV of FIG. 2.

According to the illustrated embodiment, one or more impingement structures 26A, 26B may be provided in the interior portion 11 of the airfoil body 12. Each impingement structure 26A, 26B essentially includes a hollow elongated main body 28 defining a coolant cavity 64 therewithin that receives a cooling fluid. The main body 28 is positioned between a pair of adjacent partition walls 24. Referring to FIGS. 2 and 4, the main body 28 is spaced from the pressure side wall 16 and the suction side wall 18, such that a first near wall passage 72 is defined between the main body 28 and the pressure side wall 16 and a second near wall passage 74 is defined between the main body 28 and the suction side wall 18. In the present embodiment, as shown in FIG. 3, the main body 28 may further be spaced from the airfoil tip 52 to define a gap 50 that forms a tip cooling passage 77. A plurality of impingement openings 25 are formed through the main body 28 that connect the coolant cavity 64 with the first and second near wall passages 72 and 74. The impingement openings 25 direct the cooling fluid flowing in the coolant cavity 64 to impinge on the pressure and/or suction side walls 16, 18. Additionally or alternately, one or more impingement openings 25 may be provided that direct the cooing fluid in cavity 64 to impinge on the airfoil tip 52. As shown in FIG. 3, each coolant cavity 64 is elongated, extending lengthwise in a radial direction between an open first end 36 receiving a cooling fluid 60 and a closed second end 38. In the present embodiment, the first end 36 is located at the root 56 of the turbine airfoil 10 while the second end 38 is located within the interior 11 of the airfoil body 12. The first end 36 of each coolant cavity 64 may be independently coupled to a cooling fluid supply, for example, air diverted from a compressor section. The second end 38 may be covered, for example, by a tip cap 39. As illustrated, the second end 38 of each coolant cavity 60 may terminate short of the airfoil tip 52 to define a gap 50. The provision of a gap 50 between the coolant cavity 64 and the airfoil tip 52 may serve to reduce mechanical stresses experienced by the impingement structure 26A, 26B due to differential thermal expansion with respect to the relatively hot pressure and suction side walls 16 and 18, and further provides convective shelf cooling of the airfoil tip 52. In the illustrated embodiment, the tip cap 39 may also provided with one or more impingement openings 25 for providing impingement cooling of the airfoil tip 52.

As shown in FIG. 2, each impingement structure 26A, 26B may further include a pair of connector ribs 32, 34 that respectively connect the main body 28 to the pressure and suction side walls 16 and 18. Each impingement structure 26A, 26B including the main body 28 and the connector ribs 32, 34 extends lengthwise in a radial direction. In a preferred embodiment, the impingement structures 26A, 26B may be manufactured integrally with the airfoil body 12 using any manufacturing technique that does not require post manufacturing assembly as in the case of inserts. In one example, the impingement structures 26A, 26B may be cast integrally with the airfoil body 12, for example from a ceramic casting core. Other manufacturing techniques may include, for example, additive manufacturing processes such as 3-D printing. This allows the inventive design to be used for highly contoured airfoils, including 3-D contoured blades and vanes. Embodiments of the present invention provide the possibility to bring the benefits of impingement cooling to rotating turbine airfoils such as blades, which has hitherto not been achieved due to the inability to insert impingement inserts in a turbine blade.

The main body 28 may extend across the chordal axis 30. In the illustrated embodiment, the main body 28 includes first and second opposite side walls 82, 84 that respectively face the pressure and suction side walls 16, 18. The first and second side walls 82, 84 may be spaced in a direction generally perpendicular to the chordal axis 30. In the shown embodiment, the first side wall 82 is generally parallel to the pressure side wall 16 and the second side wall 84 is generally parallel to the suction side wall 18. The main body 28 further comprises forward and aft end walls 86, 88 that may extend between the first and second side walls 82, 84 and may be spaced along the chordal axis 30. The connector ribs 32, 34 are respectively coupled to the first and second side walls 82, 84. In alternate embodiments, the main body 28 may have, for example, a triangular, circular, elliptical, oval, polygonal, or any other shape or outer contour.

In the illustrated embodiment, the impingement openings 25 are formed on the first and second side walls 82 and 84 that respectively face the pressure and suction side walls 16 and 18, to provide a targeted impingement of the cooling fluid on the regions that require the most cooling. To this end, as shown in FIG. 2, the impingement openings 25 may be oriented such that their respective axes intersect with the pressure side wall 16 or the suction side wall 18. Furthermore, as shown in FIG. 4, the impingement openings 25 may have axes that are oriented at right angles to the radial direction. In other embodiments, the impingement openings 25 may have axes oriented at varying angles with respect to the radial direction. In still further embodiments, the impingement openings may additionally be provided on the forward and aft end walls 86 and 88. The plurality of impingement openings 25 on each of the side walls 82 and 84 may be spaced in the chordal direction (FIG. 2) and further in the radial direction (FIGS. 3-4). In particular, as shown in FIG. 3, the impingement openings 25 may be arranged in an array extending along the radial and chordal directions.

As shown in FIG. 2, each impingement structure 26A, 26B divides the space between consecutive partition walls 24 into a pair of adjacent radial cavities positioned on opposite sides of the respective impingement structure 26A, 26B along the chordal axis 30. For example, a first pair of adjacent radial cavities 43-44 is defined on opposite sides of a first impingement structure 26A, while a second pair of adjacent radial cavities 45-46 is defined on opposite sides of a second impingement structure 26B. Each of the radial cavities 43-46 has a C-shaped flow cross-section, formed by a respective first near wall passage 72 adjacent to the pressure side wall 16, a respective second near wall passage 74 adjacent to the suction side wall 18, and a respective central channel 76 connecting the first and second near wall passages 72, 74. The provision of central channel 76 connecting the near wall passages 72, 74 provides reduced stress levels, particularly for rotating airfoils such as turbine blades. In the illustrated embodiment, the first near wall passage 72 is defined between the pressure side wall 16 and the first side wall 82 of the main body 28. The second near wall passage 74 is defined between the suction side wall 18 and the second side wall 84 of the main body 28. The central channel 76 is defined between a respective end wall 86, 88 of the main body 28 and a respective one of the adjacent partition walls 24. The first and second near wall passages 72, 74 and the central channel 76 extend along a radial direction, the central channel 76 being connected to the first and second near wall passages 72, 74 along a radial extent. The C-shaped flow cross-sections of the adjacent radial cavities 43-44 are symmetrically opposed with respect to each other. That is, the flow cross-section of the radial cavity 44 corresponds to a mirror image of the flow cross-section of the radial cavity 43, with reference to a mirror axis generally perpendicular to the chordal axis 30. The same description holds for the adjacent radial cavities 45-46. It should be noted that the term "symmetrically opposed" in this context is not meant to be limited to an exact dimensional symmetry of the flow cross-sections, which often cannot be achieved especially in highly contoured airfoils. Instead, the term "symmetrically opposed", as used herein, refers to symmetrically opposed relative geometries of the elements that form the flow cross-sections (i.e., the near wall passages 72, 74 and the central channel 76 in this example).

FIG. 3 schematically illustrates, in cross-sectional side view, the first impingement structure 26A. The coolant cavity 64 of the impingement structure 26A is open at the root 56 to receive a cooling fluid 60. The adjacent radial cavity 44 may be closed at the root 56. The cooling fluid 60 flows radially through the coolant cavity 64, and is discharged through the impingement openings 25 to impinge particularly on the internal surfaces of the hot pressure and suction side walls 16 and 18, and also on the airfoil tip 52 to provide impingement cooling to these surfaces. Post impingement, the cooling fluid flows through the C-shaped radial cavities 43 and 44 to provide convective cooling of the adjacent hot walls, including not only the pressure and suction side walls 16 and 18 but also the partition wall 24. In particular, the main body 28 of the impingement structure 26A displaces the cooling fluid from the center of the airfoil toward the near wall passages 72 and 74 of the radial cavities 43 and 44. The C-shaped radial cavities 43 and 44 are fluidically connected via a chordal connector passage defined by the gap 50 between the coolant cavity 64 and the airfoil tip 52. The coolant flow through the gap 50 provides shelf cooling of airfoil tip 52. In one embodiment, the airfoil tip 52 may be provided with exhaust orifices via which the coolant fluid may be discharged from the airfoil 10, providing film cooling on the external surface of the airfoil tip 52 exposed to the hot gases.

A similar description applies for the second impingement structure 26B. The coolant cavity 64 of the second impingement structure 26B is also open at the root 56 to receive a cooling fluid. The adjacent radial cavity 45 may be closed at the root 56. The cooling fluid flows radially through the coolant cavity 64 of the second impingement structure 26B, and is discharged through the impingement openings 25 to impinge particularly on the internal surfaces of the hot pressure and suction side walls 16 and 18 to provide impingement cooling to these surfaces. Post impingement, the cooling fluid flows through the C-shaped radial cavities 45 and 46 to provide convective cooling to the adjacent hot walls. The main body 28 of the second impingement structure 26B displaces the cooling fluid from the center of the airfoil toward the near wall passages 72 and 74 of the radial cavities 45 and 46. The C-shaped radial cavities 45 and 46 may be fluidically connected via a chordal connector passage defined by a gap between the coolant cavity 64 and the airfoil tip 52. In one embodiment, the airfoil tip 52 may be provided with exhaust orifices via which the coolant fluid may be discharged from the airfoil 10, providing film cooling on the external surface of the airfoil tip 52 exposed to the hot gases.

As seen, the impingement structures 26A, 26B not only provide a targeted impingement cooling, but also occupy a significant space between the partition walls 24, thereby reducing the flow cross-section of the adjacent radial cavities 43-44 and 45-46 and displacing the cooling fluid toward the pressure and suction side walls 16 and 18. Referring to FIG. 2, to provide an effective near wall cooling of the hot outer wall 14, one or more of the first and second near wall passages 72, 74 may an elongated dimension generally parallel to the chordal axis 30. That is, one or more of the near wall passages 72, 74 may have a length dimension generally parallel to the chordal axis 30 that is greater than a width dimension generally perpendicular to the chordal axis 30. Furthermore, one or more of the central channels 76 may have an elongated dimension generally perpendicular to the chordal axis 30. That is, one or more of the central channels 76 may each have a length dimension generally perpendicular the chordal axis 30 that is greater than a width dimension generally parallel to the chordal axis 30. In the illustrated embodiment, the central channel 76 extends transversely across the chordal axis 30 such that the first and second near wall passages 72 and 74 are located on opposite sides of the chordal axis 30. The illustrated embodiments make it possible to achieve higher Mach internal numbers even for low coolant flow rates.

Although not explicitly shown in the drawings, the inventive impingement cooling feature may be used in conjunction with many different cooling schemes. For example, referring to FIG. 2, from the radial cavity 43, the cooling fluid may flow in a forward direction along the chordal axis 30 into the radial cavity 42, either along a connector passage adjacent to a radially inner or outer end of the radial cavity 43, or alternately via impingement openings on the intervening partition wall 24 between the radial cavities 43 and 42. From the radial cavity 42, the coolant fluid may enter the radial cavity 41 via impingement openings on the intervening partition wall 24, and then be discharged into the hot gas path via showerhead orifices 27 (FIG. 1) at the leading edge 20. Likewise, for example, from the radial cavity 46, the cooling fluid may flow in an aft direction into the radial cavity 47, either along a connector passage adjacent to a radially inner or outer end of the radial cavity 46, or alternately via impingement openings on the intervening partition wall 24 between the radial cavities 46 and 47. The radial cavity 47 may incorporate trailing edge cooling features 49 (FIG. 2), as known to one skilled in the art, for example, comprising turbulators, or pin fins, or combinations thereof, before being discharged into the hot gas path via exhaust orifices (not shown) located along the trailing edge 22. It should be noted that the above mentioned cooling schemes are merely exemplary and the particular cooling scheme used is not central to aspects of the present invention.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A turbine airfoil comprising:

a generally hollow airfoil body formed by an outer wall extending span-wise along a radial direction, the outer wall comprising a pressure side wall and a suction side wall joined at a leading edge and a trailing edge, wherein a chordal axis is defined extending generally centrally between the pressure side wall and the suction side wall, and an impingement structure comprising a hollow elongated main body positioned in an interior portion of the airfoil body and extending lengthwise along the radial direction, the main body defining a coolant cavity therewithin that receives a cooling fluid, wherein the main body is spaced from the pressure side wall and the suction side wall, such that a first near wall passage is defined between the main body and the pressure side wall and a second near wall passage is defined between the main body and the suction side wall, wherein a plurality of impingement openings are formed through the main body that connect the coolant cavity with the first and second near wall passages, for directing the cooling fluid flowing in the coolant cavity to impinge on the pressure and/or suction side walls, wherein the impingement structure further comprises first and second connector ribs that respectively connect the main body to the pressure side wall and the suction side wall, wherein the impingement structure is manufactured integrally with the airfoil body, and wherein the impingement structure is positioned between a pair of adjacent partition walls that extend radially and further extend across the chordal axis connecting the pressure side wall and the suction side wall, wherein a respective central channel is defined between the main body and each of the adjacent partition walls, the central channel being connected to the first and second near wall passages along a radial extent, wherein a pair of adjacent radial cavities are defined on chordally opposite sides of the impingement structure with respect to the first and second connector ribs, wherein the pair of adjacent radial cavities have respective C-shaped flow cross-sections of symmetrically opposed orientations, each C-shaped flow cross-section being formed by a respective portion of the first near wall passage separated by the first connector rib, a respective portion of the second near wall passage separated by the second connector rib, and the respective central channel connecting the respective portions of the first and second near wall passages, wherein the pair of adjacent radial cavities are fluidically connected by a chordal connector passage defined between the impingement structure and a radially outer tip of the airfoil body wherein the airfoil body and the partition walls are separate structures.

2. The turbine airfoil according to claim 1, wherein the coolant cavity extends radially between first and second ends, wherein the first end is open, being connected to a cooling fluid supply external to the airfoil body, and a tip cover is disposed at the second end.

3. The turbine airfoil according to claim 2, wherein the first end is located at a root portion of the airfoil.

4. The turbine airfoil according to claim 2, wherein the second end is located in the interior portion of the airfoil body, terminating short of a radially outer tip of the airfoil body.

5. The turbine airfoil according to claim 1, wherein the plurality of impingement openings are spaced along the chordal axis.

6. The turbine airfoil according to claim 1, wherein the plurality of impingement openings are spaced along the radial direction.

7. The turbine airfoil according to claim 1, wherein the plurality of impingement openings are arranged in an array extending along the chordal and radial directions.

8. The turbine airfoil according to claim 1, wherein the main body comprises:

first and second side walls that respectively face the pressure and suction side walls, and forward and aft end walls that extend between the first and second side walls, wherein the plurality of impingement openings are arranged on the first side wall and/or the second side wall.

9. The turbine airfoil according to claim 8, wherein the first side wall of the main body is generally parallel to the pressure side wall and the second side wall of the main body is generally parallel to the suction side wall.

10. The turbine airfoil according to claim 1, wherein the plurality of impingement openings are oriented such that their respective axes intersect with the pressure side wall or the suction side wall.

11. The turbine airfoil according to claim 1, wherein each of the first and second near wall passages has an elongated dimension generally parallel to the chordal axis, the first and second near wall passages being positioned on opposite sides of the chordal axis.

12. The turbine airfoil according to claim 1, wherein the central channel extends transversely across the chordal axis.

13. The turbine airfoil according to claim 1, wherein a further plurality of impingement openings are formed through the main body that connect the coolant cavity with a tip cooling passage, for directing the cooling fluid flowing in the coolant cavity to impinge on the airfoil tip.

* * * * *